US008321985B2

(12) United States Patent
Newton

(10) Patent No.: US 8,321,985 B2
(45) Date of Patent: Dec. 4, 2012

(54) SUPPORT PLATFORM AND METHOD OF CONSTRUCTION THEREOF

(76) Inventor: John Reginald Newton, Grange over Sands (GB)

( * ) Notice: Subject to any disclaimer, the term of this patent is extended or adjusted under 35 U.S.C. 154(b) by 41 days.

(21) Appl. No.: 12/841,213

(22) Filed: Jul. 22, 2010

(65) Prior Publication Data

US 2012/0000020 A1 Jan. 5, 2012

(30) Foreign Application Priority Data

Jul. 5, 2010 (GB) ..... 1011275.3

(51) Int. Cl.
*E01D 19/12* (2006.01)

(52) U.S. Cl. ..... 14/73; 14/74.5; 14/77.1

(58) Field of Classification Search ..... 14/73, 74.5, 14/77.1, 78
See application file for complete search history.

(56) References Cited

U.S. PATENT DOCUMENTS

| | | | | |
|---|---|---|---|---|
| 4,710,994 | A * | 12/1987 | Kishida et al. | 14/77.1 |
| 4,972,537 | A * | 11/1990 | Slaw, Sr. | 14/77.1 |
| 4,977,636 | A * | 12/1990 | King | 14/73 |
| 5,132,069 | A | 7/1992 | Newton | |
| 5,802,652 | A * | 9/1998 | Smith | 14/73 |
| 6,904,636 | B2 * | 6/2005 | Hwang et al. | 14/73 |
| 8,069,519 | B2 * | 12/2011 | Bumen | 14/73 |
| 2001/0037533 | A1 * | 11/2001 | Doyle et al. | 14/73 |
| 2004/0216250 | A1 * | 11/2004 | Dumlao et al. | 14/73 |
| 2006/0272111 | A1 * | 12/2006 | Kim et al. | 14/73 |
| 2007/0180634 | A1 * | 8/2007 | Grace | 14/73 |
| 2008/0078038 | A1 * | 4/2008 | Borazghi | 14/73 |
| 2009/0077758 | A1 * | 3/2009 | Vincent | 14/73 |
| 2011/0138549 | A1 * | 6/2011 | He | 14/73 |

FOREIGN PATENT DOCUMENTS

| | | | |
|---|---|---|---|
| KR | 20-2008-0005106 | U | 11/2008 |
| KR | 10-2009-0108150 | A | 10/2009 |
| WO | 8900495 | | 1/1989 |
| WO | 9100171 | | 1/1991 |
| WO | 2007020618 | A2 | 2/2007 |

OTHER PUBLICATIONS

Intellectual Property Office, Search Report, Oct. 18, 2010 (3 pages), South Wales, United Kingdom.

* cited by examiner

*Primary Examiner* — Raymond W Addie
(74) *Attorney, Agent, or Firm* — Price Heneveld LLP

(57) ABSTRACT

A bridge superstructure comprises a first aspect of the present invention, a bridge structure comprises a contact surface supported by a decking mounted on a superstructure. The superstructure includes a mounting for the decking. The decking comprises a panel composed of a fiber reinforced polymer composite, the panel comprising a plate having an upperside and an underside, a plurality of first and second beams, each beam having an upper face and a base face and side faces, the upper face of each beam being integral with the underside of the plate, a first beam having an aperture extending between the side faces, wherein a second beam extends through the aperture. The panel further comprises means for attachment to the superstructure and a layer of wear-resistant material on the upper side of the plate.

17 Claims, 17 Drawing Sheets

SUPPORT PLATFORM AND METHOD OF CONSTRUCTION THEREOF

CROSS-REFERENCE TO RELATED APPLICATION

This application claims the benefits under 35 U.S.C. §119 (a)-(d) of Great Britain Application No. 1011275.3, filed on Jul. 5, 2010, the disclosure of which is hereby incorporated herein by reference in its entirety.

BACKGROUND OF THE INVENTION

This invention relates to support platforms, particularly but not exclusively to bridges and methods of construction thereof.

Bridges for roads and walkways have traditionally been constructed from heavy materials such as stone, steel or reinforced concrete. Conventional bridges comprise a contact surface over which a load, for example road vehicles, may pass. The contact surface must meet design criteria including wear performance, longevity, slip resistance and the ability to drain water from the contact surface. The contact surface of a bridge is not usually capable of carrying its own weight and requires to be supported by a decking. The decking provides structural support to the contact surface and transfers the load to the main bridge structure. Secondary features such as footpaths, barriers or railings can be considered as part of the decking. The main bridge structure or superstructure carries all of the elements of a bridge across the distance that the bridge must span. The design of the superstructure is complex and must take account of criteria such as seismic design, expansion considerations, substructure design and wind loadings.

The transient load of the majority of modern bridge designs will typically be in the form of vehicular traffic and the details are specified in recognised standards. An example is; AASHTO LRFD Bridge Design Specifications, Customary U.S. Units, $4^{th}$ Edition with 2008 and 2009 U.S. Edition Interims. Standard-Item Code: 15-LRFDUS-4-M. Applying these standards to bridge design allows one to determine the transient loads that must be applied to a bridge design. The transient load offers no opportunity for weight reduction as it is fixed by national and international standards and the bridge must be designed to carry the required loadings.

It is an object of the present invention to provide a decking and contact surface system for construction of bridges or other support platforms, for example for railway passenger platforms. The support platforms in accordance with this invention are referred to in this specification for simplicity as "bridges".

It is a further object to provide a deck system for road bridges. It is another object to provide a decking and contact surface for a bridge. It is a further object to provide a method of construction of a bridge, especially a road bridge.

SUMMARY OF THE INVENTION

According to a first aspect of the present invention, a bridge structure includes a contact surface supported by a decking mounted on a superstructure. The superstructure includes a mounting for the decking. The decking includes a panel composed of a fibre reinforced polymer composite. The panel includes a plate having an upperside and an underside and a plurality of first and second beams. Each beam includes an upper face and a base face and side faces. The upper face of each beam is integral with the underside of the plate. A first beam includes an aperture extending between the side faces. A second beam extends through the aperture. The panel further includes means for attachment to the superstructure. A layer of wear-resistant material is provided on the upper side of the plate.

According to a second aspect of the present invention, a method of construction of a bridge structure includes the steps of assembling a superstructure having a mounting. A panel composed of a fibre reinforced polymer composite is provided. The panel includes a plate having an upperside and an underside and a plurality of first and second beams. Each beam includes an upper face and a base face and side faces. The upper face of each beam is integral with the underside of the plate. A first beam includes an aperture extending between the side faces. A second beam extends through the aperture. The mounting is dimensioned to receive the panel. The panel is attached to the superstructure. A layer of wear-resistant material is provided on the upper side of the plate.

The bridge of the present invention may comprise a road bridge, railway bridge, footbridge or other support platform, for example a railway platform. The bridge or platform may be a permanent structure. Alternatively, a temporary or emergency bridge or platform may be provided.

The bridge structure and method of construction confer considerable advantages. The panels may be made in a factory for assembly on site, reducing the difficulty in working in adverse weather conditions. The speed of assembly is much greater than for conventional bridge constructions, resulting in particular applications in emergency or military situations or where disruption to traffic is undesirable.

Bridge structures in accordance with this invention preferably are capable of supporting the high loadings generated by high volume vehicular traffic for 25 years. The structures may have a high wear resistant surface which may maintain a minimum wet coefficient of friction value of 0.5.

The surface preferably includes a configuration adapted to facilitate removal of water. The layer of wear resistant material may include a tread pattern arranged to provide a drainage channel on the upper side of the plate. Preferably a network of drainage channels for example a groove pattern is provided to facilitate drainage of rainwater from the bridge surface.

Attachment of the panels described to the bridge superstructure requires an attachment system that can withstand the high number of loadings the panel is expected to encounter in use. The system is preferably capable of being deployed rapidly at the time of initial assembly and also if a panel needs to be replaced. The kinematics of the design should ensure movements due to temperature changes are accommodated and that vibration from constant traffic has no detrimental effect on the attachment system.

A fully constrained attachment system is preferred. Suitable attachment systems are adapted to accommodate minor movements in the superstructure, for example caused by thermal expansion, load variations, wind forces and variations in traffic densities.

In preferred embodiments, the superstructure includes a mounting dimensioned to receive a panel, the attachment means comprising a projection extending upwardly from the mounting, and a socket in the panel adapted to receive and engage the projection to secure the panel to the mounting.

Each panel may include two or more sockets. One socket and projection may be configured to form a secure engagement to prevent movement of the panel, a second socket and projection being configured to engage the panel to the mounting but permitting relative movement to accommodate thermal expansion.

The socket and projection may form a friction engagement to locate the panel in the desired location; both or other fasteners may not be required, particularly for temporary bridges for example for military use. Quick release fasteners may be employed, for example the type produced by Dzus.

In a particularly preferred embodiment, the socket is located between adjacent first and second beams of the panel. In this embodiment the configuration of intersecting beams provides an economical and efficient means of robustly locating the means of attachment within the decking. Preferably the first and second beams are arranged in parallel, for example rectangular, arrays wherein a pair of first beams and a pair of second beams are configured to form a four sided cavity to accommodate the socket.

The panel may advantageously have closed edges. The upper and base portions and sides may form an integral solid flange extending peripherally of the panel. This arrangement allows the load to be transmitted in use through the peripheral flanges so that the attachments are not load supporting.

The panels may be manufactured according to the process disclosed in EP 3655579, the disclosure of which is incorporated into this specification by reference for all purposes.

Preferred materials comprise a composite of glass fibre for example E-glass fibres. The glass fibres may be in the form of woven or stitch bonded fabrics. Polyester, epoxy or polyurethane resins may be used. The preferred resin is a urethane-acrylate resin, for example a methacrylate resin. The composite may be manufactured in accordance with the disclosure of EP 6766094, the disclosure of which is incorporated into this specification by reference for all purposes.

A typical glass fibre composite panel produced as detailed above may measure 1374 mm×600 mm and may weigh 50 kg. The panel may span 1274 mm and when loaded centrally via a plate 230 mm×230 mm provide a failure load of 400 kN.

The contact surface may comprise a layer of aggregate particles embedded in the surface of the glass fibre composite.

Suitable aggregates include silicon carbide, silica, sand or crushed granite.

A preferred aggregate is calcined bauxite. A particularly preferred material has a particle size of 14/30 mesh. Use of calcined bauxite is preferred because it has a hardness value of 9 on the Mohr scale and does not polish because the particles retain their sharp edges in use.

When incorporated into a tread pattern the aggregate preferably increases the coefficient of friction of the tread to a value greater than 0.5. This provides excellent grip properties. These properties are preferably retained throughout the life of the tread. Wear tests have shown that the treads in accordance with this invention can have a life of 100,000,000 foot placement events when leather soled shoes are used by a pedestrian. Rolling contact of rubber tyres is less aggressive and the life is therefore greater.

Attachment of the panels described to the bridge superstructure requires an attachment system that can withstand the high number of loadings the panel is expected to encounter in use. The system is preferably capable of being deployed rapidly at the time of initial assembly and also if a panel needs to be replaced. The kinematics of the design should ensure movements due to temperature changes are accommodated and that vibration from constant traffic has no detrimental effect on the attachment system.

The composite panel, for example a square or rectangular panel, may be provided with a cavity at two locations of the lower face. The locations are preferably disposed in spaced locations on the lower face, for example on opposite sides thereof. The cavity accommodates an attachment means that is adapted to be attached to the bridge superstructure. Preferably, the attachment means includes a shock absorber arrangement and includes means to permit a panel to be attached to the mounting. The panel at each of the two cavities may have moulded within the composite structure means for securing the panel to the mounting, for example a member having a threaded bore for receiving and locking in place a retaining bolt.

In one embodiment, the two cavities in the panel have the same dimensions and two different sizes of projection. The first size matches the dimensions of the cavity and when the panel is placed onto the mounting the panel it is fully constrained in the X and Y axes and also preventing rotation in the Z direction. The second size of mounting may have the same dimensions as the first mounting in the Y axis and is smaller in the X axis. The second mounting serves to restrain the panel in the Y axis but permits limited movement in the X axis. With this arrangement the panel is fully constrained in both the X and Y axes and also preventing Z rotation whilst allowing for small expansion movements between panel and superstructure due to temperature changes or other effects.

The panel may be secured in the Z axis by placing a retaining bolt or other fixture through the attachment means in the panel and screwing it into the mounting. A bolt head locking spring may be fitted to the attachment means to prevent movement of the bolt. The attachment means may be sealed using a sealant composition or an elastomeric plug.

The mountings may be attached to the main body of the superstructure by four bolts. The method of securing these bolts may depend on the material used for the structural element of the superstructure. For example if steel is used then it may be drilled and tapped to provide threaded holes or it may be drilled and locking washers and locking nuts could be used. The objective is to provide the optimum system for the material being used and ensure a secure system is deployed that will not corrode.

In situ the panels may be sealed by the inclusion of a sealing member or application of appropriate mastic. The edges of the panels may include a ledge arrangement to support a sealing member.

Panels in accordance with this invention may incorporate sensors to generate signals indicative of movement of the panel, deformation of the panel or to allow identification of each panel for maintenance purposes. The sensor may be embedded within the composition during moulding. This way the sensor may be protected from corrosion or tampering by the surrounding composite.

The superstructure may comprise any conventional bridge or platform structure to include steel, aluminium, reinforced composite, reinforced concrete, stone or wooden superstructures mounted on appropriate foundations.

This invention provides the following advantages when compared to conventional bridge construction systems: (1) a significant reduction in the weight of the three main elements of a bridge, the wear surface, decking and superstructure; (2) all components can be manufactured in a factory environment; (3) on site work consists only of assembly; (4) on site assembly of panels that create the decking and wear surface can be performed rapidly without heavy lifting equipment; and (5) long life components that can be replaced within a very short time period. Panels that provide the decking and wear surface when attached to the bridge superstructure can immediately accept transient loads such as vehicular traffic.

BRIEF DESCRIPTION OF THE DRAWINGS

The invention will now be described by means of example but not in any limitative sense with reference to the accompanying drawings of which.

DETAILED DESCRIPTION OF EMBODIMENTS

Figure 1:
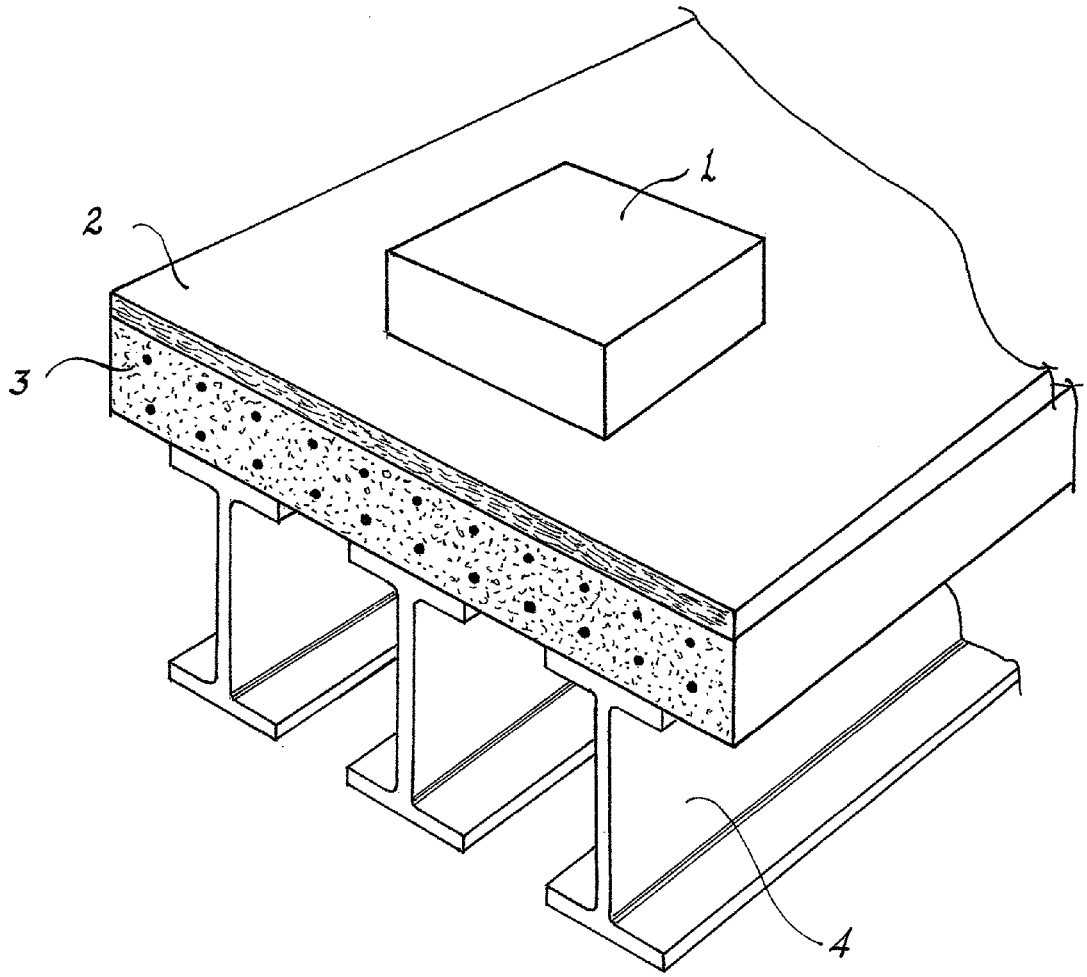
FIG. 1 is a cross sectional view through a typical bridge structure.

The function of a bridge is to carry a transient load (1) from one location to a second location. In FIG. 1 the transient load (1) travels on a wear surface (2) which can be replaced when worn out and provides selected properties such as a high coefficient of friction to provide good grip, drainage properties to assist dispersal of water and good wear resistance. The wear surface is structurally supported by a decking (3). The decking (3) is designed to carry the weight of the transient load (1), the weight of the wear surface (2) and the weight of the decking (3) and to transfer these loads to the superstructure (4).

The superstructure (4) can be made from engineering materials such as steel, aluminium, reinforced concrete or glass reinforced composite. The superstructure (4) is often made from wide-flange beams or I-beams that are designed to support the transient load (1), which may have very high dynamic and static loading conditions associated with vehicles travelling over or stopped on the superstructure (4). Bridge superstructures can be designed in a number of configurations and these are to a certain extent dictated by the span of the bridge and weight to be carried over the span. A principal object of this invention is to reduce the weight of the total structure in order to offer a designer a greater selection of materials and structural configurations.

Figure 2:
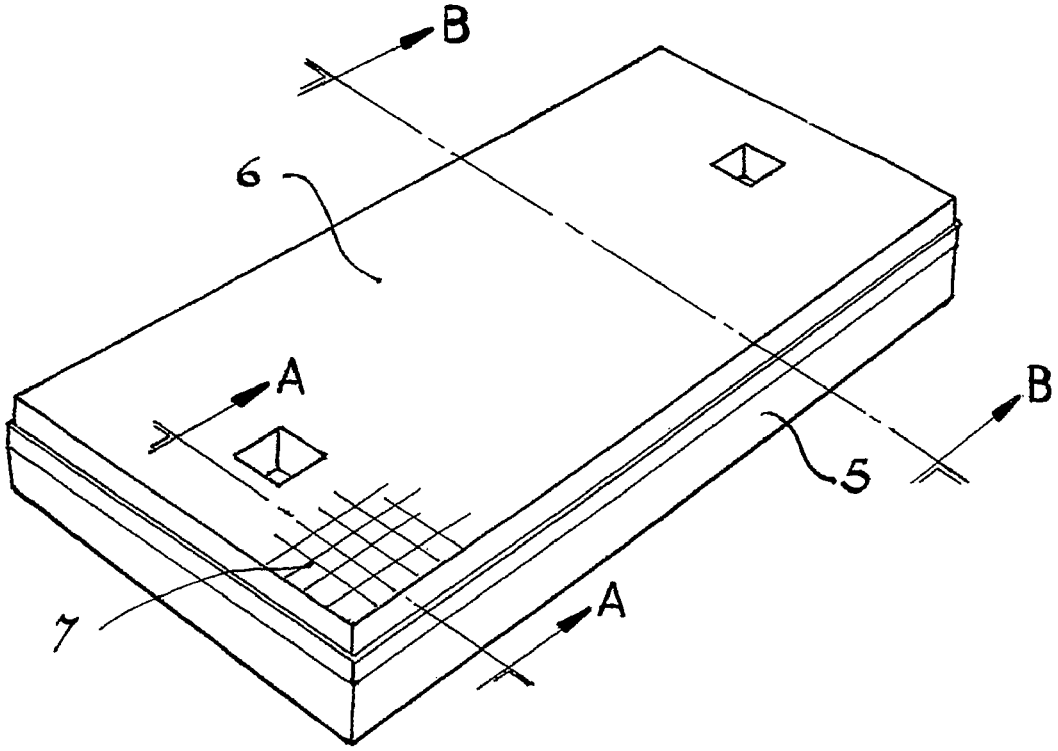
FIG. 2 is an isometric view of top face of a composite panel.

Referring to FIG. 2, the wear surface (2) and the decking (3) are combined into a panel (5) which may be made from an advanced composite material preferably composed of glass fibre reinforcing fibres and a urethane-acrylate matrix resin. The top surface (6) which is in contact in use with transient load (1) provides the same function as a conventional wear surface (2). In order to create a wear surface (2) the top surface (6) is provided with a tread pattern (7). The tread pattern (7) functions to disperse surface water and provide grip. The tread pattern (7) on the top surface (6) may have a variety of different designs and constructions that increase the frictional resistance between the transient load (1), which could be foot traffic or vehicles, and the top surface (6).

Figure 3:
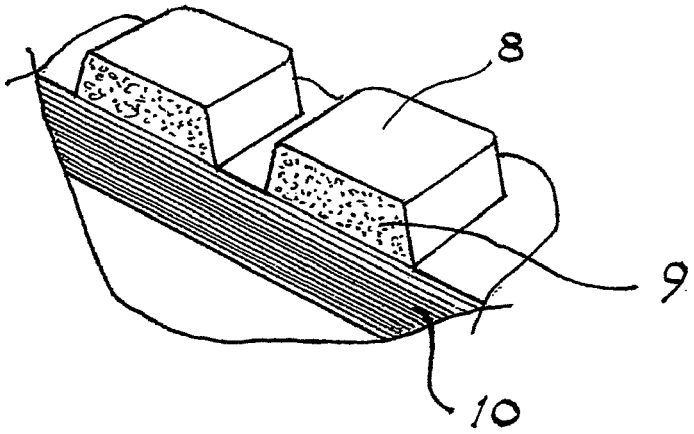
FIG. 3 is a sectional view through a tread and top laminate of the panel.

Referring to FIG. 3, each of the tread elements (8) contains grains of aggregate preferably 14/30 mesh calcined bauxite (9) which are packed at maximum packing density throughout the entire depth of the each tread element (8). During manufacture of the panel (5) the urethane-acrylate matrix resin is infused through the calcined bauxite (9) bonding the calcined bauxite (9) together and to the composite laminate (10). A preferred tread pattern (7) provides a wear surface with a coefficient of friction better than 0.5 and exceptional wear properties. The tread depth may be typically 6 mm (¼") and may have a lower specific gravity than a typical wear surface (2). A conventional wear surface (2) would be typically 50 mm (2") thick and if there was no difference in specific gravity, the tread pattern (7) would only represent 12.5% of the weight of a conventional wear surface (2). This provides a saving in weight of 87.5%.

The composite panel (5) is preferably made using the composite structure described in WO 2007/020618. This can provide the structural strength of a bridge decking whilst offering a significant weight saving in the region of 80% when compared to typical reinforced concrete decking.

The manufacturing process involves building a preform of glass fibre laminates which take the same form as the finished product. The preform together with embedded components such as metal items and the wear surface aggregate, preferably calcined bauxite are loaded into a mould. The mould is closed and sealed. Low level vacuum is applied to the mould and then catalysed urethane-acrylate resin is injected into the mould and infused through the fibre structure and calcined bauxite. Once the mould is filled it is sealed and the resin given time to cure.

The mould is then opened and the completed component removed. Flash is removed and the product is then complete. The process of moulding may take about 20 minutes.

The process of injection is carried using a commercially available machine. A typical example is the injection machine supplied by Autisan International of Sarasota, USA.

Building of the preforms can involve a number of techniques and depends on the shape and complexity of the product. Typically different fabrics of glass fibre are cut to precise shapes and assembled into the preform. Polyurethane cores can be used to attach the laminates. The laminates can be thermally heat bonded or stitch bonded. A combination of methods may be used.

Figure 4:
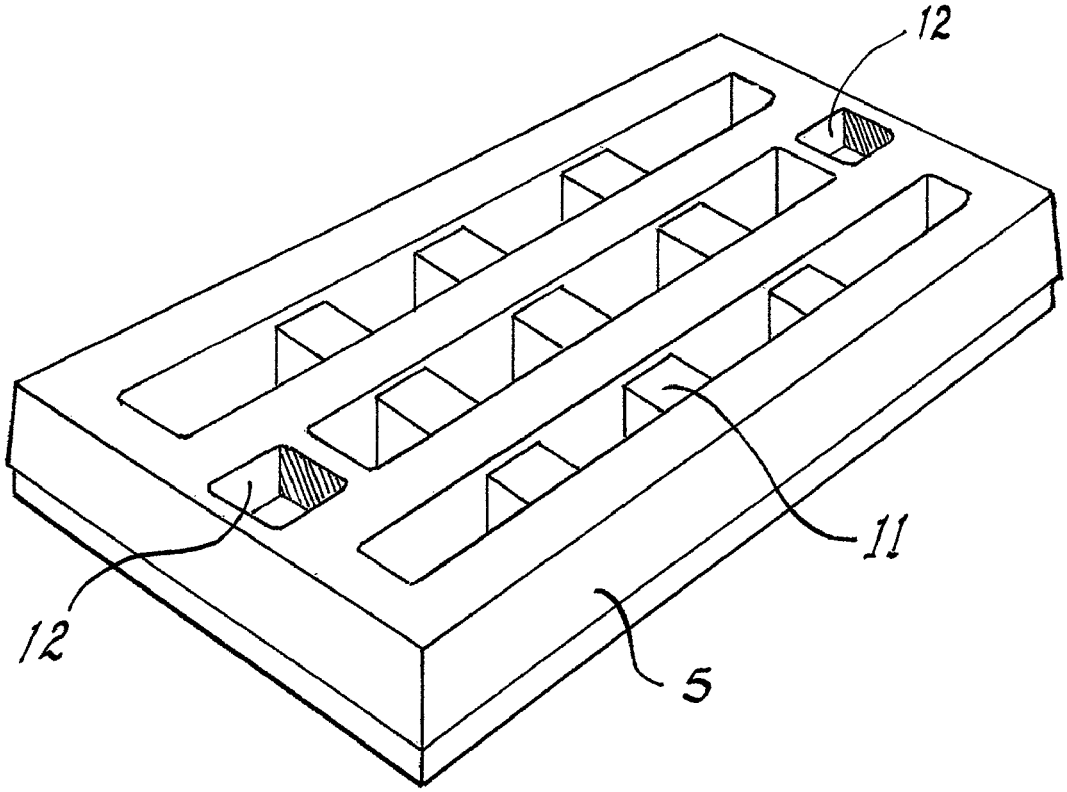
FIG. 4 is an isometric view of a lower face of the composite panel.

In FIG. 4 the lower face of panel (5) is shown. The beam structure (11) that provides the structural strength is illustrated and at both ends of panel (5) a socket (12) is provided that is formed within the beam structure (11). The function of the sockets is to provide part of an attachment system (13) to connect panel (5) to the bridge superstructure (4). Locating the sockets (12) within the beam structure (11) places them structurally within a very strong part of the panel ensuring that panel (5) and superstructure (4) will be capable of withstanding the loads imposed by vehicle traffic.

Figure 5:
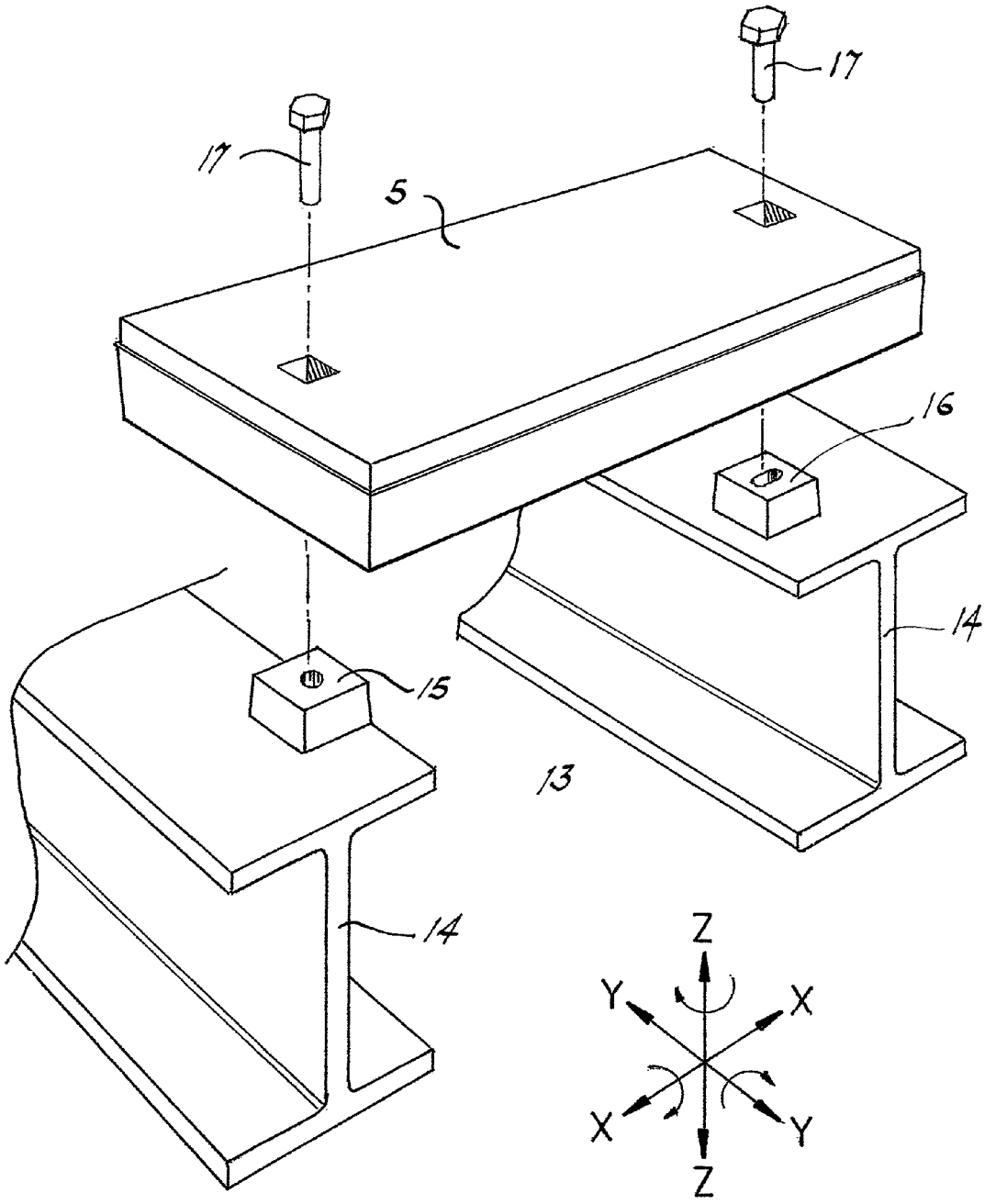
FIG. 5 is an isometric view of a panel and attachment system to a bridge superstructure.

In FIG. 5 two 'I' beams (14) of a bridge superstructure (4) are shown. Attached to the 'I' beams are mounting units (15) and (16). During assembly the panel (5) is lowered onto the 'I' beams (14) so that the mounting units (15) and (16) locate in the sockets (12) provided in the lower face of the panel (5). The result is that the panel (5) is fully constrained in axis X and Y and Z rotation. Fitting the two retaining bolts (17)

constrains the panel (5) in the X, Y and Z axes. Panel (5) is fully constrained by this attachment system (13). Mounting unit 15 includes a substantially circular receiving aperture while mounting unit 16 includes an elongate receiving aperture that provides increased tolerance to the attachment system (13), thereby ensuring connectability of the panel (5) to the 'I' beams (14).

Figure 6:
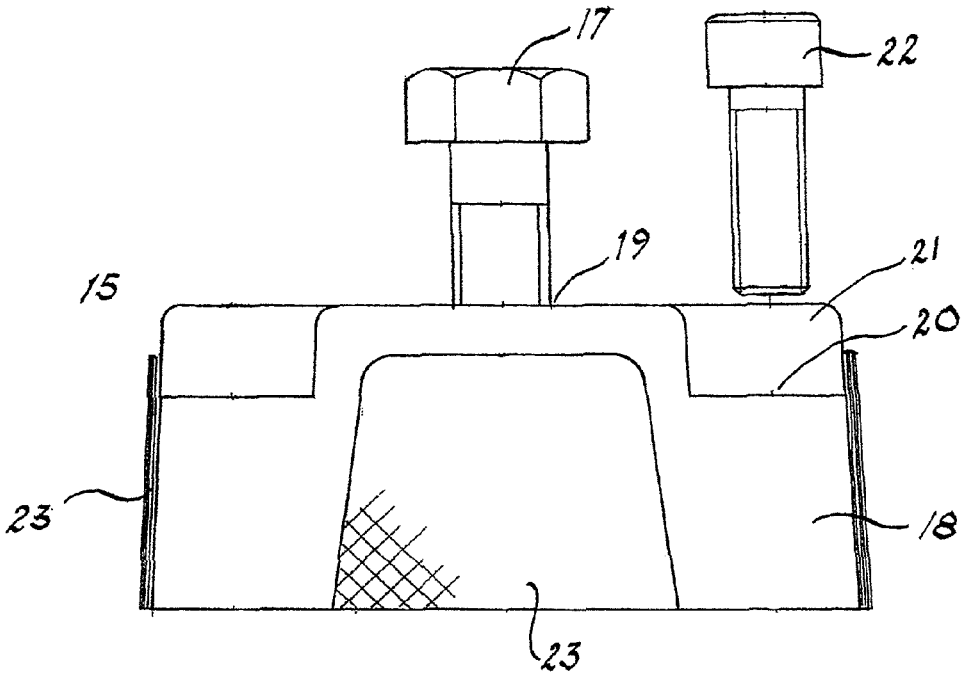
FIG. 6 is a side view of a mounting unit that is fully constrained.

In FIG. 6 the mounting unit (15) of attachment system (13) is shown. Mounting unit (15) has a housing (18) typically made as a die casting from high grade aluminium such as LM 25-TF (BS 1490). A central hole (19) in the top face of the housing (15) is provided to receive a retaining bolt (17). Each corner of housing (18) is provided with a hole (20) and recess (21) to receive a socket head cap screw (22) whose function is to clamp the housing (18) to the superstructure (4). On each of the four side faces of housing (18) is a shock absorber (23), for example made of a nitrile rubber. When panel (5) is assembled the four faces of cavity (12) each contact a corresponding shock absorber (23). Tightening the retaining bolt (17) causes the shock absorbers (23) to be compressed to a predetermined amount.

Figure 7:
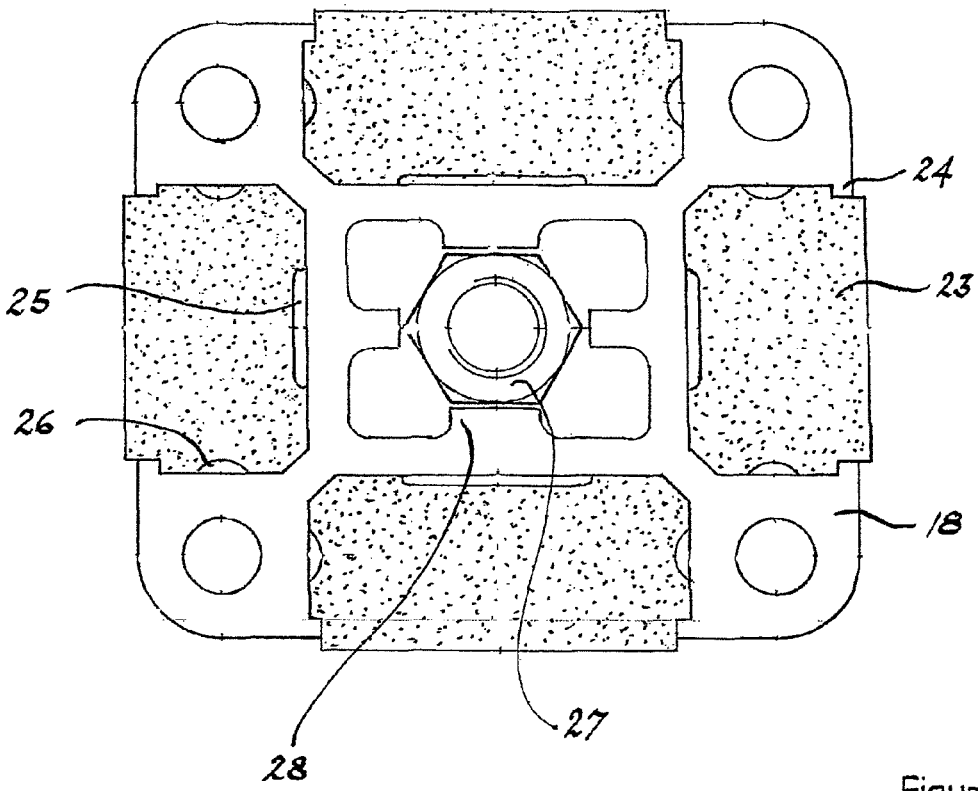
FIG. 7 is a view of a lower face of mounting unit that is fully constrained.

Referring to FIG. 7 it can be seen that retaining lip (24) locates and retains the shock absorber (23) within housing (15). Voids (25) and (26) are provided for shock absorber (23) to be compressed into when panel (5) is positioned onto attachment system (13) and retaining bolt (17) fitted and fully tightened. In the centre of the lower surface of housing (18) a nut (27) is located and retained by walls (28). When panel (5) is assembled on to attachment system (13) retaining bolt (17) can be screwed into nut (27).

Mounting unit (15) constrains panel (5) in the X and Y axes and prevents Z rotation. Restraining bolt (17) constrains the panel (5) in the vertical Z axis. Shock absorbers (23) restrict minor movement, such as vibratory movement, of panel (5), resulting from dynamic loading conditions, which could lead to wear occurring between panel (5) and the superstructure (4). This restriction also helps to damp noise.

Figure 8:
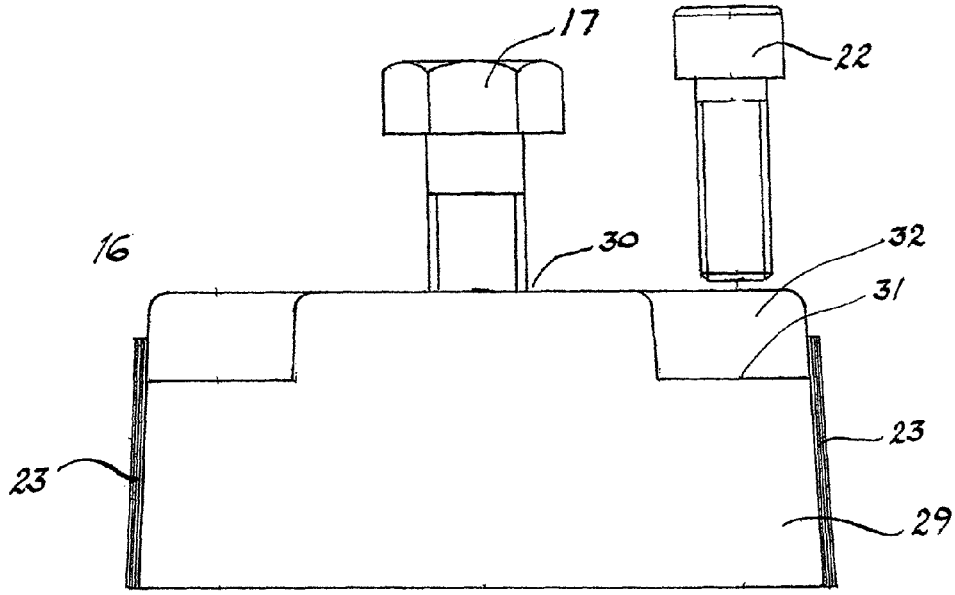
FIG. 8 is a side view of a mounting unit that is constrained only in the Y axis.

In FIG. 8 the mounting unit (16) of attachment system (13) are described in detail. Mounting unit (16) has a housing (29) typically made as a die casting from a high grade aluminium such as LM 25-TF. A centrally positioned slot (30) is provided to receive a retaining bolt (17). Each of the four corners of housing (29) are provided with a hole (31) and recess (32) to receive a socket head cap screw (22) whose function is to clamp housing (29) to the superstructure (4). On two sides of housing (29) a shock absorber (23), typically made of nitrile rubber, is provided. When panel (5) is assembled on attachment system (13) the shock absorbers (23) contact the two faces of cavity (12) which are parallel with the long side of panel (5). Tightening retaining bolt (17) causes the shock absorbers to be compressed a predetermined amount.

Figure 9:
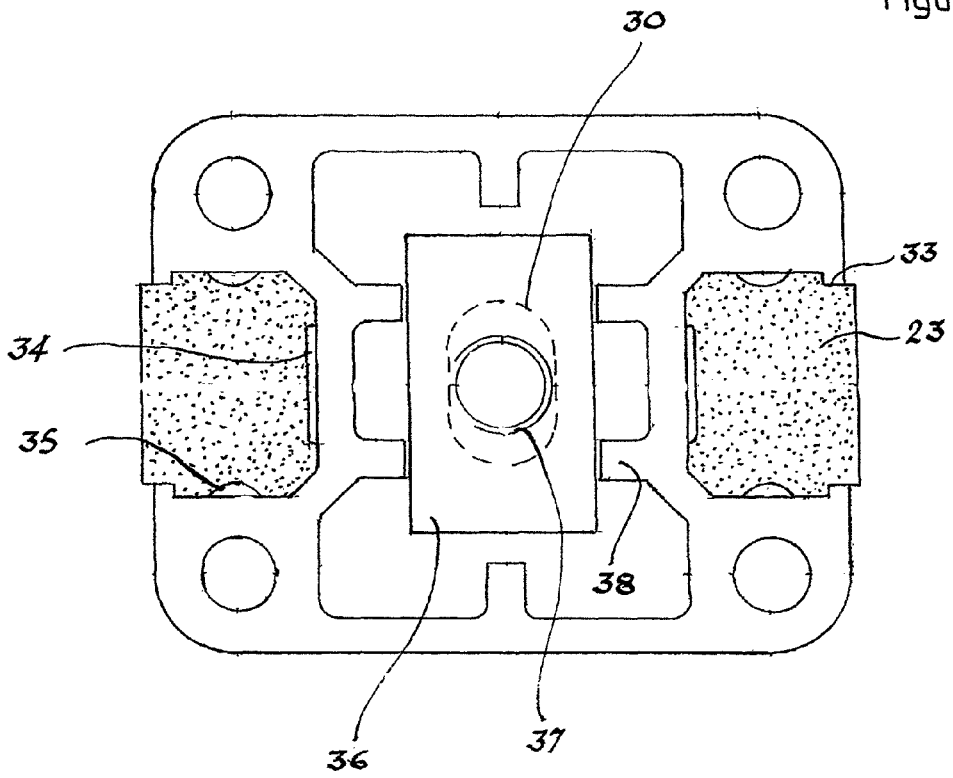
FIG. 9 is a view of a lower face of a mounting unit that is constrained only in the Y axis.

In FIG. 9 it can be seen that retaining lip (33) locates and retains the shock absorber (23) within housing (16). Voids (34) and (35) are provided for shock absorber (23) to be compressed into when panel (5) is positioned onto attachment system (13) and retaining bolt (17) fitted and fully tightened. In the centre of the lower surface of housing (16) a plate (36) with a threaded hole (37) is located and prevented from rotating by walls (38). The plate (37) receives retaining bolt (17) and together with plate (37) they have limited movement in the longitudinal direction of panel (5) in the region of ±5 mm (3/16"). This arrangement accommodates any small movement of the superstructure (4) which can be caused for example by temperature changes.

Mounting unit (16) constrains panel (5) in the Y axis and prevents Z axis rotation. Restraining bolt (17) constrains panel (5) in the vertical Z axis. Mounting unit (16) permits limited movement of panel (5), in relation to mounting unit (15), in the X axis and compensates for small movements within superstructure (4). Shock absorbers (23) restrict minor movement in the Y axis and would permit movement in the X axis.

Figure 10:
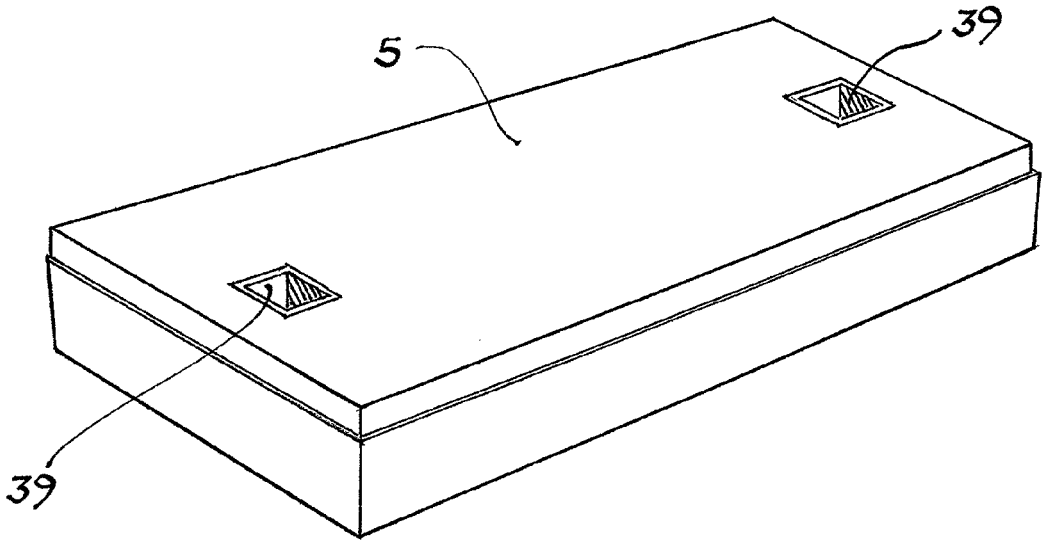
FIG. 10 is an isometric view of the top face of a composite panel showing an attachment means.

Referring to FIG. 10 each panel (5) is attached to mounting system (13) and hence the bridge superstructure (4) by two retaining bolts (17). In order to accommodate bolts (17) panel (5) has two stainless steel housings (39) which serve as attachment points moulded into the composite structure.

Figure 11:
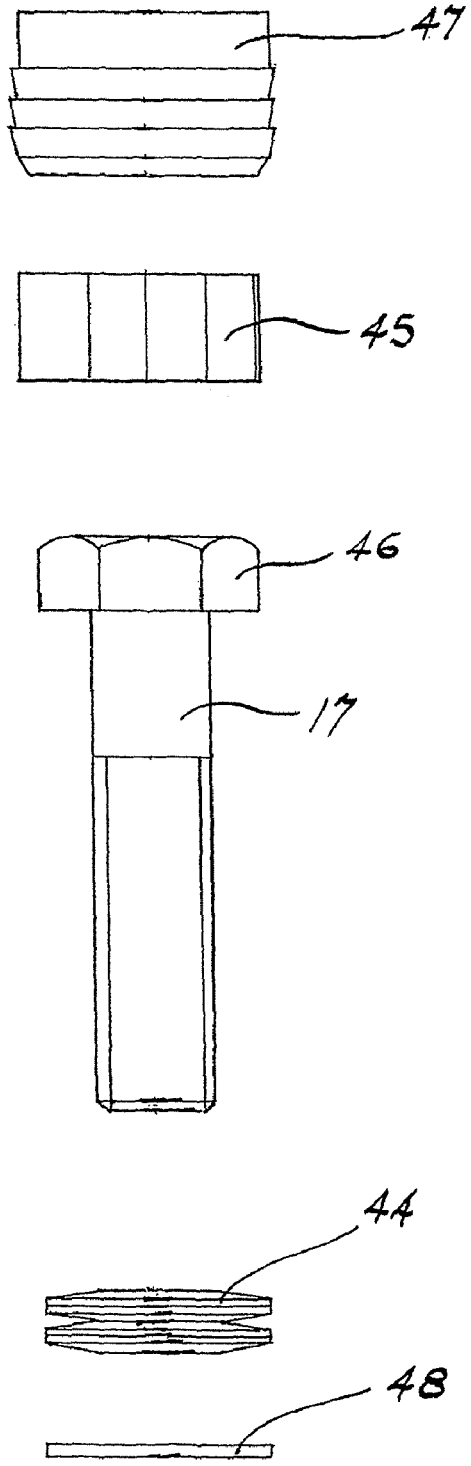
FIG. 11 is a view of an attachment bolt and accompanying components.

In FIG. 11 attachment bolt (17) forms part of an assembly comprising of a washer (48), a high rate compression spring (44), a bolt head lock spring (45) and a sealing plug (47) which are typically made of nitrile rubber.

Figure 12:
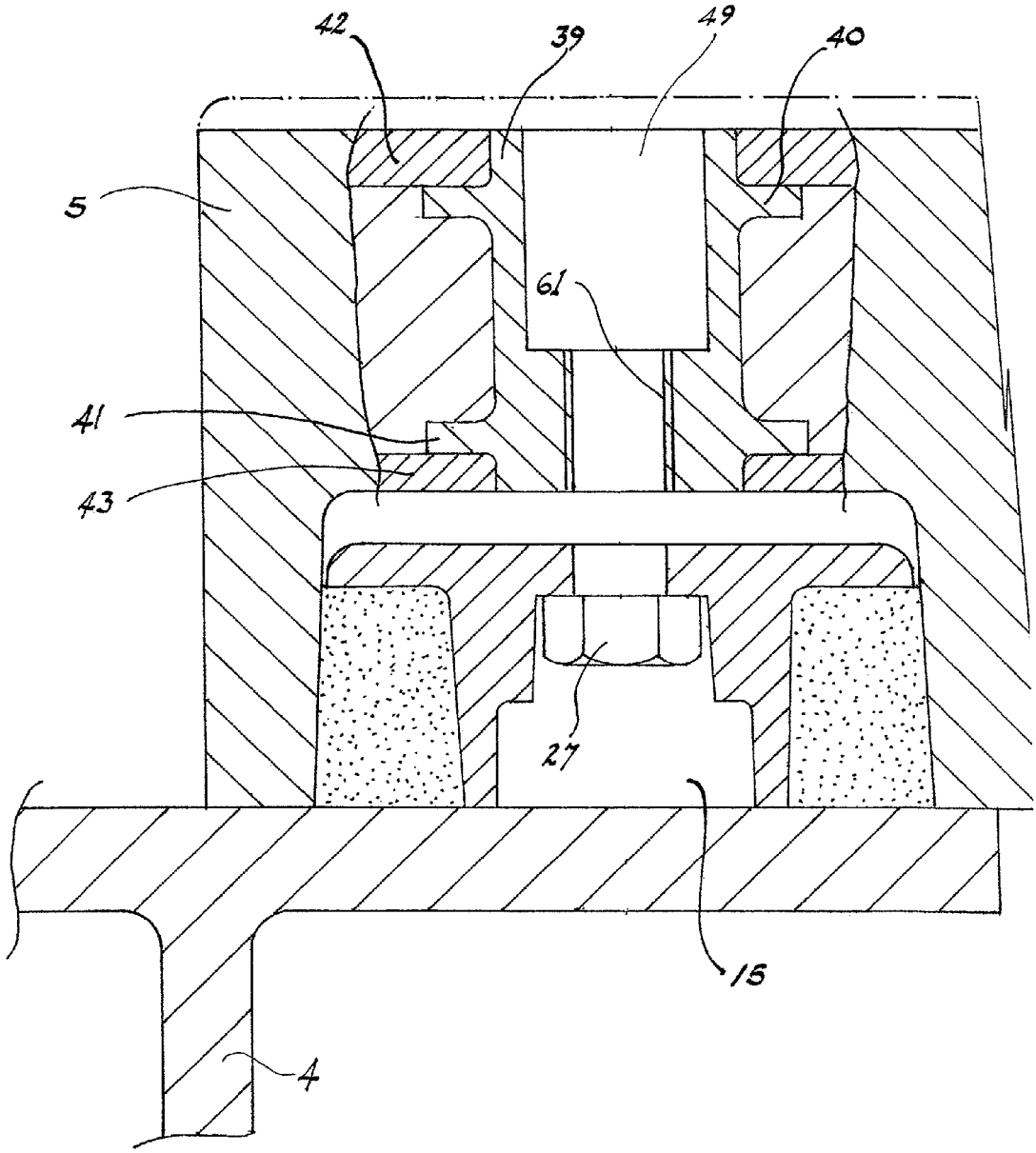
FIG. 12 is a sectional view through a panel and mounting unit at the attachment means.

Referring to FIG. 12 housing (39) provides multiple functions. To ensure housing (39) can transfer the loads imposed by bolt (17) into the composite structure of panel (5) the housing has flanges (40) and (41) which transfer load into composite laminates (42) and (43) which are an integral part of panel (5). Housing (39) has a recess (49) which accommodates a washer (48), a high rate compression spring (44), the head of retaining bolt (17), a bolt head lock spring (45) and sealing plug (47). Attaching panel (5) to mounting system (13), retaining bolt (17) is placed through compression spring (44) washer (48) into housing (39) and then through either mounting unit (15) or (16). Retaining bolt (17) is then screwed into nut (27) and plate (37) respectively. Retaining bolts (17) are tightened to a specified torque value which preloads compression spring (44). The hexagon head (46) of retaining bolt (17) is then locked in position by the insertion of the bolt head locking spring (45) into recess (49). A sealing plug (46) is then inserted into recess (49).

Figure 13:
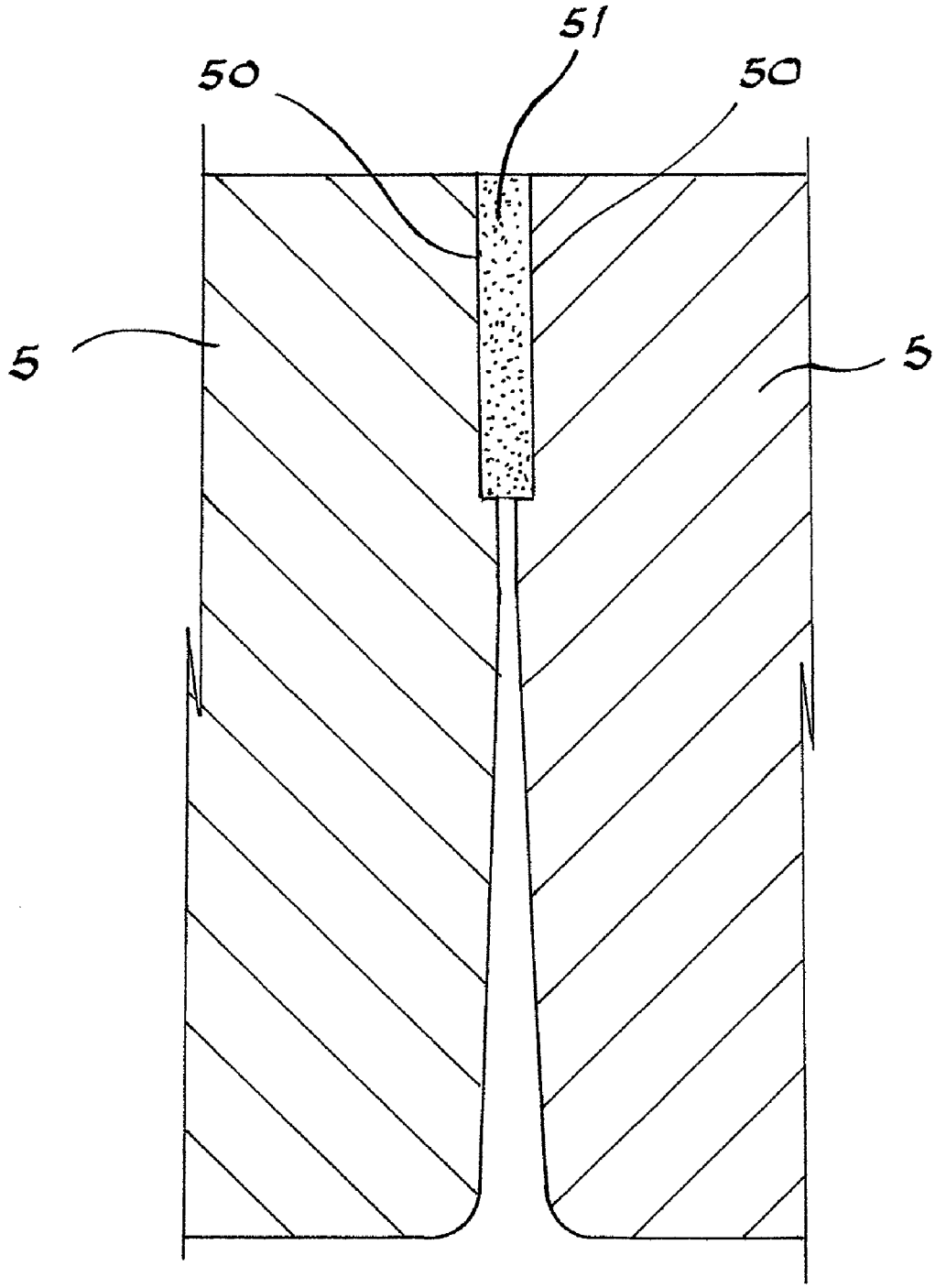
FIG. 13 is a sectional view through an interface of two panels.

In FIG. 13 the adjoining edges (50) of adjacent panels (5) are shaped to accommodate a seal (51). The seal can take the form of either mastic, such as a polyurethane material injected into the gap or an elastomer seal bonded to the edge (50) of panel (5). A suitable material would be an EPDM or nitrile rubber.

The attachment system (13) has been shown to attach and fully constrain a panel (5) to a bridge superstructure (4) and also accommodate small movements within the superstructure (4) relative to panel (5). Providing cavities (11) within the main beam structure which accommodate the attachment system (13) provides an additional safety feature in that if retaining bolt (17) was to fail it is unlikely that panel (5) would be dislodged as it is not reliant on bolt (17) because traffic automatically restrains movement of panel (5) in the vertical direction of the Z axis.

The method of construction and assembly of this invention is as follows:

Panels (5) are manufactured as individual units preferably in a very limited size range and typically would measure 600 mm×1200 mm×150 mm deep.

Each panel (5) are complete with an integral wear surface (6) and housings (39).

The superstructure (4) may be fabricated within a factory. Attachment system (13) may be precision fitted to the appropriate members of superstructure (4). On site the superstructure (4) may be assembled and when complete the panels (5) may be laid and sealed so as to create the decking and wear surface simultaneously. In this way a vehicle delivering panels (5) may advance along the bridge as the panels are laid in front of it.

Figure 14:
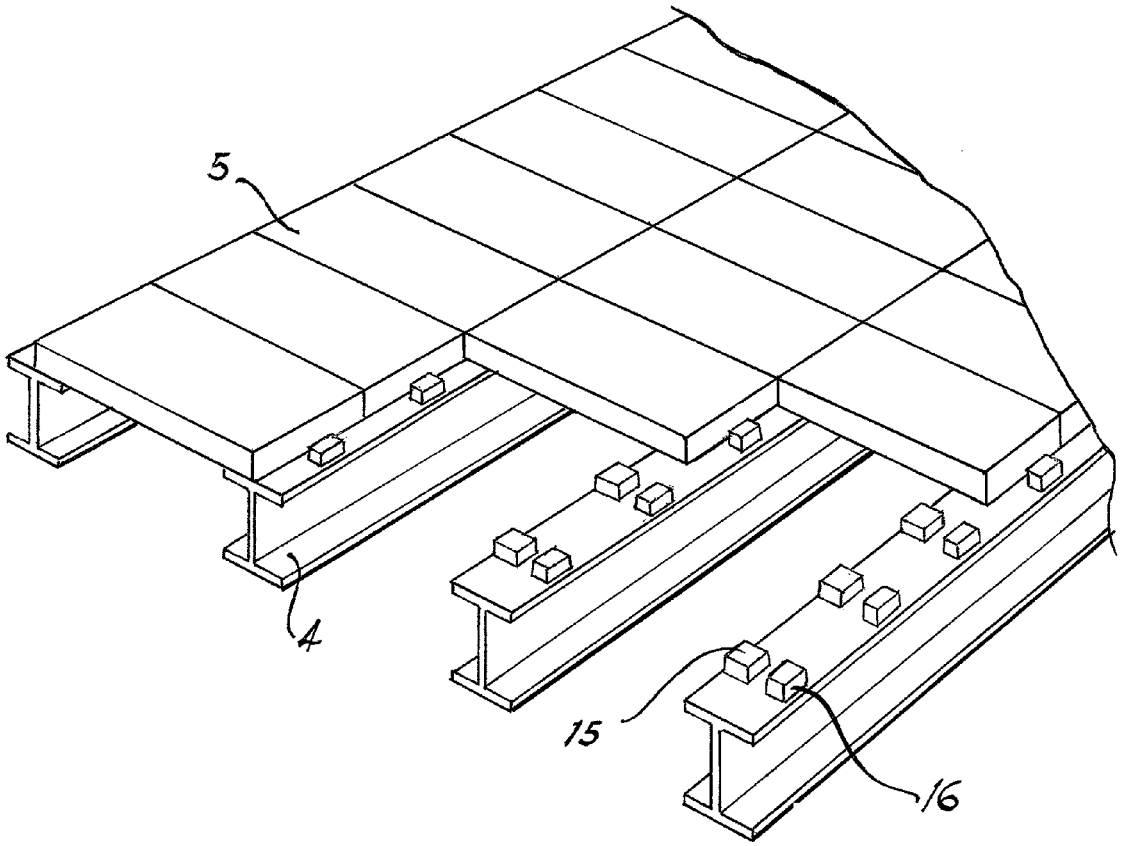
FIG. 14 illustrates stages in assembly of a bridge in accordance with this invention.
Figure 15:
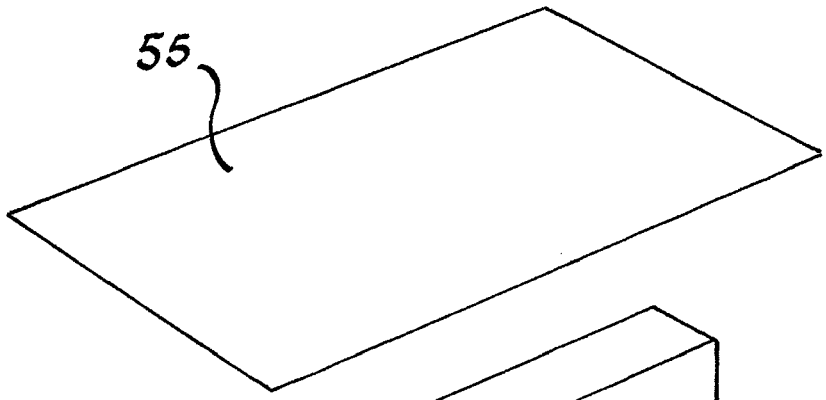
FIGS. 15 to 20 illustrate successive stages in the manufacture of a composite panel.
Figure 16:
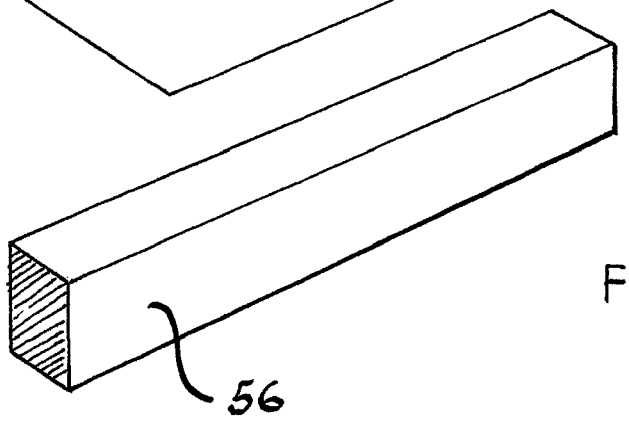
Figure 17:
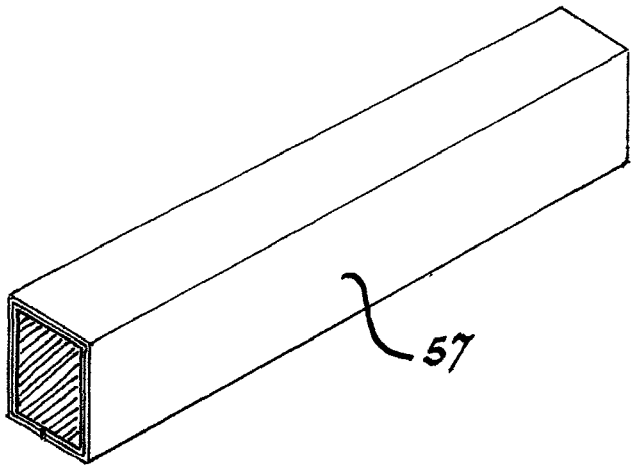

FIG. 14 illustrates the assembly of a bridge in accordance with this invention. An array of superstructure beams (4) are provided with upwardly extending mounting units (15, 16)

arranged in pairs to be received into sockets on the underside of panels (5) so that the panels abut to form a continuous surface.

During the stages of assembly the panels may be laid on the superstructure to provide a working surface from which further panels may be laid. In this way a bridge may be assembled quickly without need for scaffolding. Application of a surface layer of bitumen is unnecessary. Panels may be removed individually for replacement as necessary without impeding use of adjacent panels.

FIGS. 15 to 20 illustrate successive steps in the manufacture of a composite panel for use in accordance with this invention. A method as disclosed in WO2007/020618, the disclosure of which is incorporated into the present specification by reference for all purposes, is preferably employed.

Laminate profiles (55) are precision cut from glass fibre fabric to specific design requirements of fibre quantities and orientations. Foam cores (56), preferably made from polyurethane foam are moulded to the precise internal dimensions of the element of which they form a part. The cut laminate profiles which can range in number from 1 to more than 15 are assembled onto the foam core to make a beam (57) and held in place by stapling onto the foam core (56).

Figure 18:
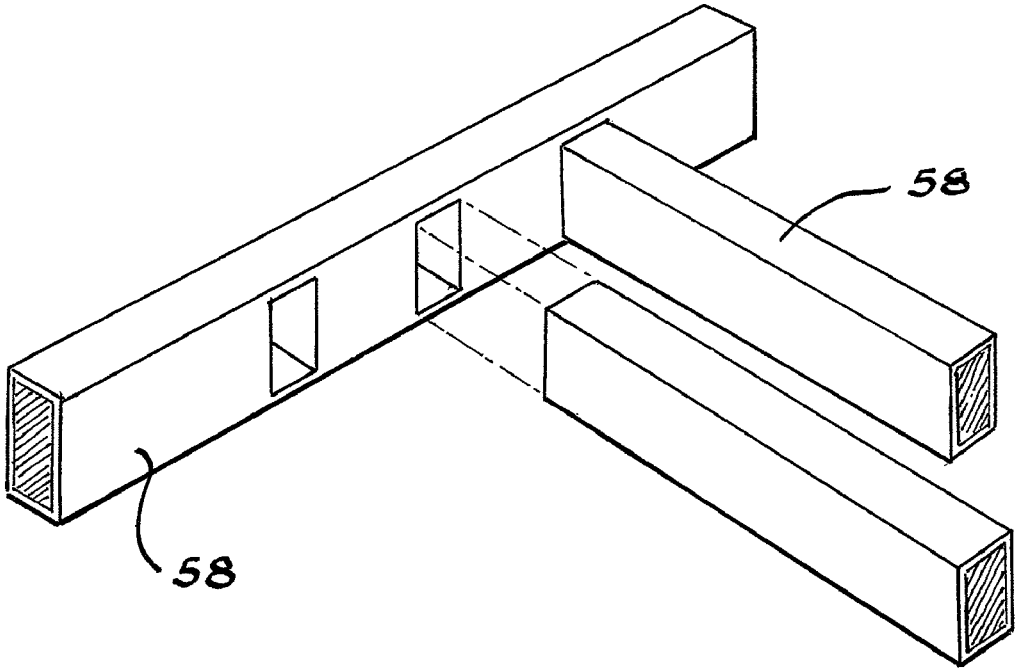
Figure 19:
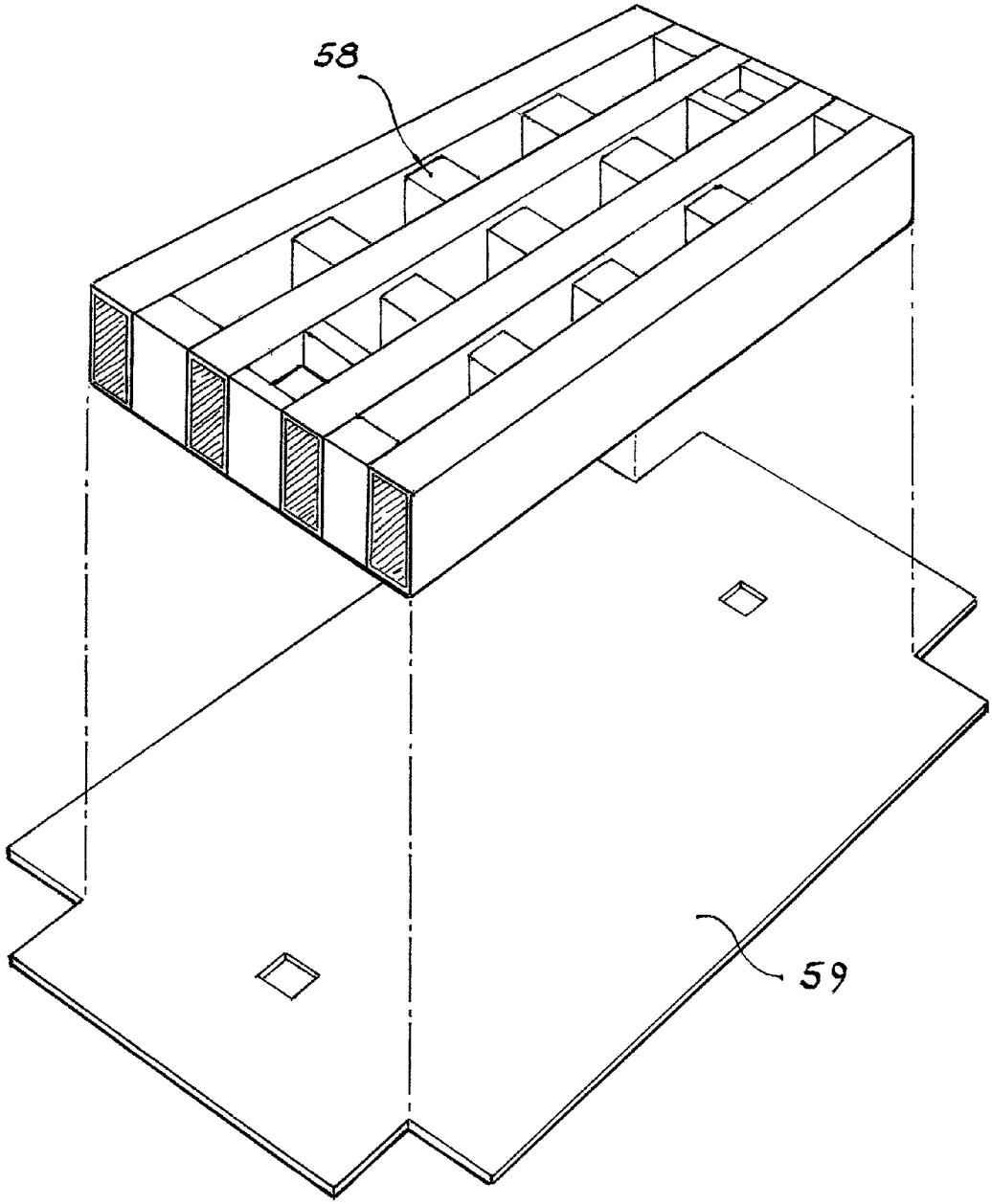

The beams (57) are then built into an assembly (58) as shown in FIG. 18.

Figure 20:
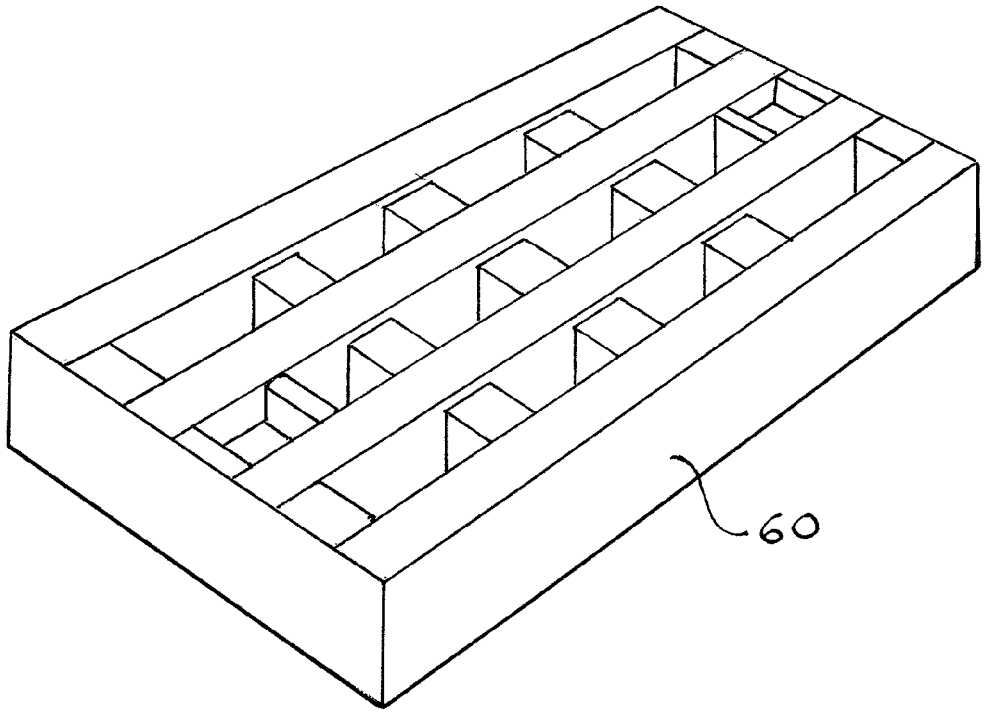

A laminate sheet (59) which serves to form the top face (6) of panel (5), can consist of a number of fibre profiles, typically 10 or more, is placed into a jig. The beam assembly (58) is then precisely located onto laminate (59) which is then attached to the beam assembly by staples or by methods such as stitching and/or adhesive bonding, to create a completed perform (60) as shown in FIG. 20.

Figure 21:
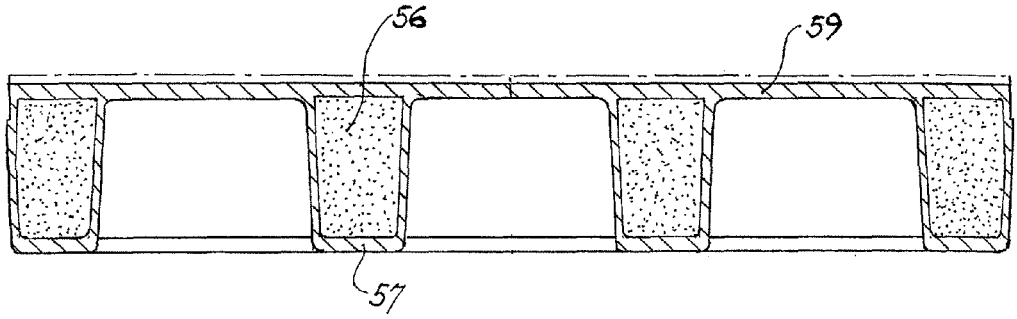
FIG. 21 is a cross sectional view of a panel.

FIG. 21 is a cross section of 'B"B' through the panel shown in FIG. 2. The cores (56) are enclosed in laminate sheets (57, 59). The top layer (59) is integral with the bottom and side layers (59).

Figure 22:
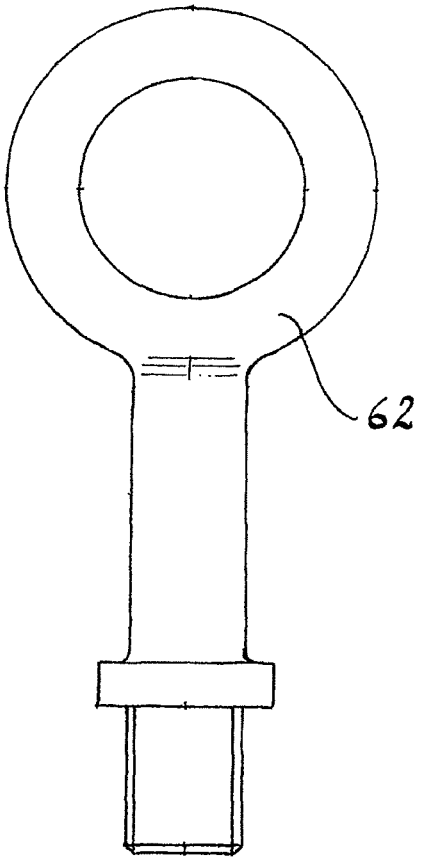
FIGS. 22 and 23 illustrate tools for installation and removal of panels during assembly of a bridge structure.

FIG. 22 is a view of an eye bolt suitable to attach to panel.

Figure 23:
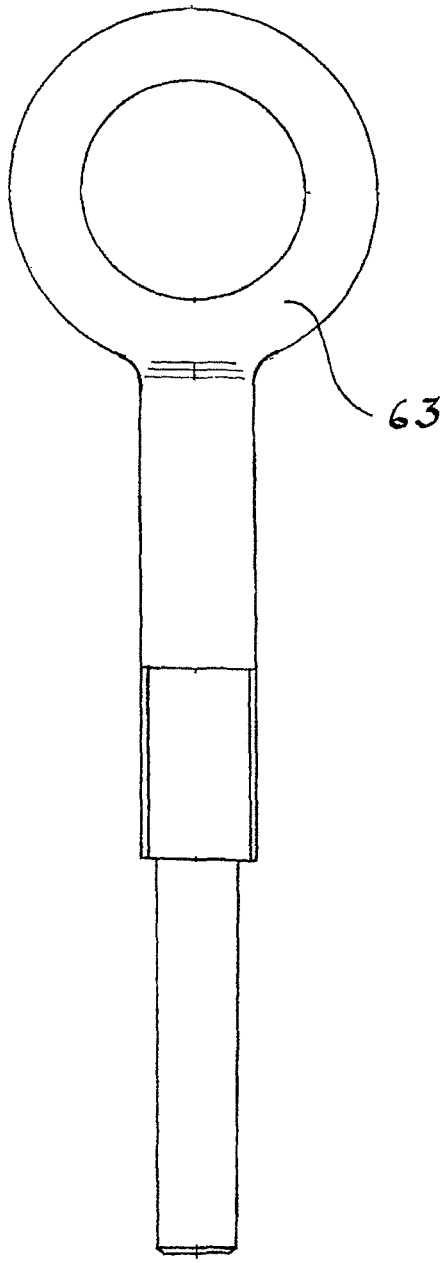

FIG. 23 is a view of a modified eye bolt suitable to dislodge and remove panel.

In the majority of applications when panels are installed there is no access to the lower face of the panel that would allow the panel to be lifted and removed. If the panel had become stuck to some degree over time to its mounting then the task of removing the panel would become even more difficult.

To provide solutions to this problem the hole in flange (39) through which bolt (17) passes was provided with a thread (61) of sufficient size that would allow bolt (17) to pass through. Typically flange (39) would have a thread size of M20 and bolt (17) would be an M16.

Providing a thread in flange (39) permits either an eye bolt (62) or modified eye bolt (63) to be attached. To remove a panel the procedure is to remove bolts (17) from the panel and replace them with eye bolts (62). Lifting gear can then be used to dislodge and lift the panel. An alternative method is to use a modified eye bolt (63) having an elongate shank. When the bolt is screwed in to flange (39) the extended front end (64) passes through mounting (15/16) and contacts the superstructure (4). Continuing to turn eye bolt (63) generates a separation force lifting panel (5) off mounting (15/16). Once the panel is separated the eye bolt (63) may be used to provide lifting means to fully remove the panel.

The invention claimed is:

1. A bridge structure comprising:

a contact surface supported by a decking mounted on a superstructure wherein the superstructure includes a mounting for the decking and wherein the decking comprises a panel composed of a fibre reinforced polymer composite, the panel comprising:

a plate having an upperside and an underside;

a plurality of first and second beams, each beam having an upper face, a base face and side faces, the upper face of each first beam being integral with the underside of the plate, each first beam having a plurality of apertures that extend between the side faces, wherein the plurality of second beams extend through the apertures;

an attachment system for attaching the panel to the superstructure; and a layer of wear-resistant material on the upper-side of the plate.

2. The bridge structure as claimed in claim 1, wherein the attachment system includes the mounting and a socket in the panel, wherein the mounting is dimensioned to be received by the socket.

3. The bridge structure as claimed in claim 2 wherein the socket is located between the first and second beams of the panel.

4. The bridge structure as claimed in claim 1, wherein the attachment system includes the mounting, the mounting being defined by a first mount unit and a second mount unit, and two or more sockets adapted to receive and engage the first and second mounting units to attach the panel to the superstructure.

5. The bridge structure as claimed in claim 1, further comprising:

a first socket and a first mount unit configured to form a secure engagement and to prevent movement of the panel in use, and a second socket and a second mount unit configured to engage the panel, permitting relative movement thereof.

6. The bridge structure as claimed in claim 5, wherein the first and second sockets are located between the first and second beams of the panel.

7. The bridge structure as claimed in claim 1, further comprising:

a pair of first beams and a pair of second beams each arranged in parallel arrays, wherein the pair of first beams and the pair of second beams are configured to form a four sided cavity to accommodate a socket in the panel.

8. A bridge structure comprising:

a contact surface supported by a decking mounted on a superstructure wherein the superstructure includes a mounting for the decking and wherein the decking comprises a panel composed of a fibre reinforced polymer composite, the panel comprising:

a plate having an upperside and an underside;

a plurality of first and second beams, each beam having an upper face, a base face and side faces, the upper face of each first beam being integral with the underside of the plate, each first beam having a plurality of apertures that extend between the side faces, wherein the plurality of second beams extend through the apertures, an attachment system for attaching the panel to the superstructure; and a housing formed in the panel and having a flange disposed therein for transferring an external load to the panel.

9. The bridge structure as claimed in claim 8, wherein the attachment system includes the mounting and a socket in the panel, wherein the mounting is dimension to be received by the socket.

10. The bridge structure as claimed in claim 8, wherein the attachment system includes the mounting, the mounting being defined by a first mount unit and a second mount unit, and two or more sockets adapted to receive an engage the first and second mount units to attach the panel to the superstructure.

11. The bridge structure as claimed in claim 8, further comprising:

a first socket and a first mounting unit configured to form a secure engagement and to prevent movement of the panel in use, and a second socket and a second mounting unit configured to engage the panel, permitting relative movement thereof.

12. The bridge structure as claimed in claim 8, further comprising:

a pair of first beams and a pair of second beams each arranged in parallel arrays, wherein the pair of first beams and the pair of second beams are configured to form a four sided cavity to accommodate a socket in the panel.

13. A bridge structure comprising:

a contact surface supported by a decking mounted on a superstructure wherein the superstructure includes a mounting for the decking and wherein the decking comprises a panel composed of a fibre reinforced polymer composite, the panel comprising:

a plate having an upperside and an underside;

a plurality of first and second beams, each beam having an upper face, a base face and side faces, the upper face of each first beam being integral with the underside of the plate, each first beam having a plurality of apertures that extend between the side faces, wherein the plurality of second beams extend through the apertures, an attachment system for attaching the panel to the superstructure; and a layer of wear resistant material including a tread pattern arranged to provide a drainage channel on the upper-side of the plate.

14. The bridge structure as claimed in claim 13, wherein the attachment system includes the mounting and a socket in the panel, wherein the mounting is dimensioned to be received by the socket.

15. The bridge structure as claimed in claim 13, wherein the attachment system includes the mounting, the mounting being defined by a first mount unit and a second mount unit, and two or more sockets adapted to receive and engage the first and second mount units to attach the panel to the superstructure.

16. The bridge structure as claimed in claim 13, further comprising:

a first socket and a first mounting unit configured to form a secure engagement and to prevent movement of the panel in use, and a second socket and a second mounting unit configured to engage the panel, permitting relative movement thereof.

17. A method of construction of a bridge structure comprises the steps of:

assembling a superstructure including a mounting;

providing a panel composed of a fibre reinforced polymer composite, the panel comprising a plate having an upperside and an underside, a plurality of first and second beams, each beam having an upper face and a base face and side faces, the upper face of each first beam being integral with the underside of the plate, each first beam having a plurality of apertures that extend between the side faces, wherein the plurality of second beams extend through the apertures, wherein the mounting is dimensioned to receive a socket in the panel;

attaching the panel to the superstructure; and providing a layer of wear-resistant material on the upper-side of the plate.

* * * * *